United States Patent [19]

Kitamura et al.

[11] Patent Number: 4,781,951

[45] Date of Patent: Nov. 1, 1988

[54] ARTIFICIAL FUR

[75] Inventors: Hiroshi Kitamura, Kusatsu; Seiichi Yamagata, Otsu, both of Japan

[73] Assignee: Toray Industries, Inc., Tokyo, Japan

[21] Appl. No.: 142,336

[22] Filed: Dec. 29, 1987

Related U.S. Application Data

[63] Continuation of Ser. No. 911,934, Sep. 26, 1986, abandoned.

[30] Foreign Application Priority Data

Oct. 11, 1985 [JP] Japan ..... 60-224867

[51] Int. Cl.[4] ..... H01N 1/00

[52] U.S. Cl. ..... 428/17; 428/89; 428/90; 428/92; 428/95

[58] Field of Search ..... 428/17, 89, 90, 92, 428/95

[56] References Cited

U.S. PATENT DOCUMENTS 4,546,020 10/1985 Sakai et al. ..... 428/89

*Primary Examiner*—Marion C. McCamish

*Attorney, Agent, or Firm*—Armstrong, Nikaido, Marmelstein & Kubovcik

[57] ABSTRACT

An artificial fur having an at least double erect pile layer structure comprising an erect pile layer of long fibers and that of short fibers. The lightness of the short fibers is lower by 0.5 or above, preferably by 2.5 or above, than that of the long fibers.

18 Claims, 1 Drawing Sheet

ARTIFICIAL FUR

This application is a continuation of application Ser. No. 911,934, filed Sept. 26, 1986, now abandoned.

BACKGROUND

This invention relates to an artificial fur having a high-grade appearance.

There have been proposed a number of artificial furs made to imitate natural furs such as minks. A typical example thereof is an erect pile fabric having a two-layer structure comprising bristle and wooly hair layers. In such an artificial fur made to imitate a mink as described above, these bristle and wooly hair erect piles have lengths of approximately 15 to 30 mm and 5 to 20 mm, respectively. Thus the former is generally longer by at least several millimeters than the latter to thereby make the two-layer structure as distinct as possible. In addition, this erect pile fabric generally has dark bristles and pale wooly hairs in order to imitate a mink.

Mink furs, which are highly evaluated and particularly popular among natural furs, may be classified into black ones including "black glamour" minks and dark minks; brown ones including dark brown "mahogany" minks and pale brown "lunarain" and pastel minks; white ones including sapphire minks as well as other various types. Any of these natural furs has dark bristles and pale wooly hairs. This relationship between the lightnesses of the bristles and wooly hairs of each animal is determined by provision of nature so that it is rarely variable.

In the field of artificial furs, it is difficult by conventional techniques of erect pile fabrics to completely imitate natural furs in all respects including the forms, properties, densities and conditions of the bristle and wooly hair piles. Further an artificial fur made to imitate the color tones of natural bristles and wooly hairs either has poor appearance since the wooly hairs rising to the surface of the fur among the bristles make the latter inconspicuous or lacks the depth of color. Therefore conventional artificial furs have a poor appearance three-dimensionally. Thus it is difficult to obtain artificial furs having an appearance or giving an impression of high-gradeness comparable to, or even exceeding, those of minks. It is furthermore very difficult in the art to closely imitate natural furs in all respects including the forms, properties, densities and conditions of bristle and wooly hair piles.

The relationship between the colors of bristles and wooly hairs of a natural fur is as described above. We have examined the correlationship between the colors of bristles and wooly hairs of an artificial fur in order to obtain a product which has the most desirable appearance closely similar to that of a natural fur. Consequently we have found that the delicate correlationship between the colors of bristles and wooly hairs significantly affects the whole appearance of a product to thereby determine the commercial value of the same.

SUMMARY

It is an object of the present invention to provide an artificial fur having a high-grade appearance comparable to, or even exceeding, that of natural furs.

It is another object of the present invention to provide an artificial fur having bristles, i.e., conspicuous erect piles comprising long fibers which has excellent depth and definition of color as well as a fine gloss and is comparable to, or even exceeding, a natural fur in its appearance and impression of high-gradeness.

In order to achieve these objects, the present invention provides an artificial fur which has at least two erect pile layers comprising one layer of long fibers and another of short fibers characterized in that the lightness of said short fibers is lower by 0.5 or above, preferably by 2.5 or above, than that of said long fibers. More particularly, the artificial fur of the present invention is further characterized in that the color of said short fibers is substantially achromatic.

THE DRAWINGS

THE PREFERRED EMBODIMENTS

Figure 1A:
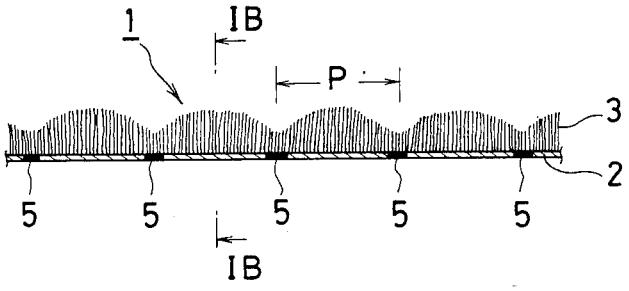
FIG. 1A is a sectional view of the artificial fur of an Example of the present invention taken vertical to the hair.

A color is generally expressed by its three characteristics including lightness, hue and chroma. These characteristics may be expressed in figures by, for example, "L, a, b" color specification with the use of a color difference meter. Examples of the color difference meter are a Hunter's direct-reading photoelectric color difference meter and a digital colorimetric color difference computer AUD-SCH-2 (mfd. by Suga Test Instruments Co., Ltd.). The lightness, i.e., the L value may be determined thereby. This L value is expressed by a figure of 0 to 100. The larger value represents the higher lightness, i.e., the more light color. Therefore the L value of black is almost 0 while that of white is almost 100.

In the present invention, an artificial fur product having conspicuous erect piles comprising long fibers of excellent color depth and definition as well as a fine gloss is finally obtained. Thus it is required that the difference in the lightnesses ($\Delta L$) of the long and short fibers forming the erect piles is 0.5 or above and that the lightness (L) of the short fibers is lower than that (L) of the long fibers.

Namely, the difference in the lightnesses among the long and short fibers should be 0.5 or above, preferably 2.5 or above. A difference in the lightnesses of less than 0.5 is undesirable since it cannot give an artificial fur excellent in the color depth and definition.

It is further required that the lightness of the short fibers is lower than that of the long fibers. When the lightness of the short fibers is higher than that of the long fibers, the short fibers rise to the surface of the product among the long fibers, which results in an undesirable and poor appearance.

In the present invention, the lightness (L) of the long fibers and that of the short fibers are determined according to the method as defined in JIS-Z-8722. Namely, the value of each fibers is independently determined after dyeing the same either in the form of raw hairs before forming an artificial fur or in the form of erect piles after forming thereof. In the latter case, piles comprising long fibers may be separated from those comprising short fibers prior to the determination.

The expression "substantially achromatic" as used herein include not only white, gray and black colors but also somewhat bluish or reddish gray and black colors. The degree of these colors may be expressed by figures according to the "L, a, b" color specification as defined in JIS-Z-8722. Thus the expression "substantially achromatic" as used herein means those showing a and b values within ±4, i.e., having absolute values of 4 or below when subjected to colorimetry with the use of a c light source which is an artificial natural light.

In addition, the larger figure in the positive region of the a value denotes a more reddish color while the larger figure in the negative region thereof denotes a more greenish color. On the other hand, the larger figure in the positive region of the b value denotes a more yellowish color while the larger figure in the negative region thereof denotes a more blueish color. In the present invention, it is preferable that the absolute a and b values of the short fibers are smaller than 4. When the absolute a or b value exceeds 4, the high degree of a red, green, yellow or blue color might lower the effect of the present invention. For example, black artificial furs wherein the long fibers are red, the b value of the short fibers is 1 and the a value thereof is:

(1) larger than 4; or (2) smaller than −4;

or the one where the a value of the short fibers is 1 and the b value thereof is:

(3) larger than 4; or (4) smaller than −4;

are evaluated. As a result, the product (1) has a poor color depth as the whole. On the other hand, the products (2), (3) and (4) have each an undefinite appearance wherein the red color of the long fibers is mixed together with the green, yellow or blue color.

Figure 1B:
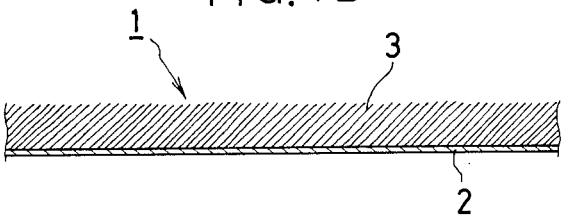
FIG. 1B is a sectional view taken along line IB—IB of FIG. 1A.
Figure 2:
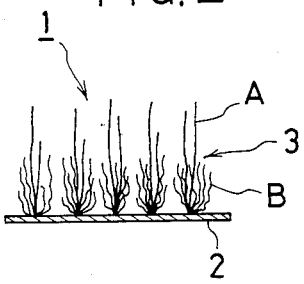
FIG. 2 is an enlarged schematic illustration of erect piles of FIG. 1A.
Figure 3:
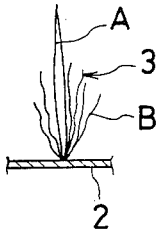
FIG. 3 is a model view of the same erect piles as those described above.

In the present invention, a number of erect fibers 3 forming an erect pile structure are filled on a base fabric 2 to thereby form an artificial fur fabric. The erect pile layer of the erect fibers 3 inclines to the base fabric 2 along the hair, FIG. 1B. Thus it is desirable that the erect pile layer forms ridges along the hair in the section vertical to the hair as shown in FIG. 1A, i.e., a multiridge structure, in order to improve the voluminousness of the artificial fur. As shown in FIG. 1A, a number of erect fibers 3 different from each other in length are arranged on a ridge in such a manner that the longer erect fiber is located closer to the center of the width P of the ridge to thereby form a convex erect pile layer. Namely, the variation in the length of the erect fibers contributes to emphasize the voluminousness of the product. In order to further emphasize the voluminousness of the same, the width P of each ridge is preferably within a range of 3 to 10 cm. The erect fibers 3, which are shown in detail in an enlarged view in FIG. 2, have a two-layer structure comprising long fibers A and short fibers B. FIG. 3 is a model view of the long fibers A and short fibers B in an erect pile 3.

The long fibers A as mentioned herein correspond to bristles of a fur having a two-layer structure and are generally longer and thicker than wooly hairs. Bristles generally cover wooly hairs, form the external appearance of a fur and impart the texture of the same. Preferable bristles are strong and highly elastic and have an appropriate thickness. Namely, it is desirable to employ fibers having a single fiber fineness of 5 to 60 deniers, preferably 20 to 50 deniers, and an average fiber length of 10 to 70 mm, preferably 20 to 60 mm.

On the other hand, the short fibers B correspond to wooly hairs of a fur having a two-layer structure and are shorter than the bristles. They exhibit effects of protecting the erect properties and elasticity of the bristles and of keeping out the cold. These short fibers generally have a single fiber fineness of 0.1 to 5 deniers, preferably 1 to 3 deniers, and an average fiber length of 5 to 50 mm, preferably 10 to 40 mm.

The long fibers A are longer than the short fibers B by several millimeters or above, preferably by 5 mm or above.

Examples of fibers available for the bristles and wooly hairs as mentioned above are synthetic fibers such as polyester, polyamide and polyacryle, regenerated fibers such as rayon and cuprammonium rayon, semisynthetic fibers such as acetate, natural fibers such as cotton, linen and wool and mixtures thereof.

In the artificial fur of the present invention, it is preferable that the tip of each erect pile is sharpened in order to further improve the texture, touch and appearance of the same. This improving effect may be achieved at least by sharpening the tips of the bristle erect piles. However the touch and texture of the product are furthermore improved by sharpening the tips of the wooly hair erect piles too.

Therefore polyester synthetic fibers such as polyethylene terephthalate and polybutylene terephthalate among the fibers as cited above are preferable for these erect piles since they can be readily sharpened and are highly elastic.

When bristles made of synthetic fibers are used in the present invention, the synthetic fibers are preferably subjected to a thermal treatment after spinning and drafting and in a straight form without any crimp. Extremely preferable bristles having straight erect pile properties, an excellent appearance and soft touch may be obtained by further sharpening such straight fibers as mentioned above. On the other hand, it is preferable that the wooly hairs show low crimp, i.e., having a crimp ratio of approximately 13% or below and the number of crimps of approximately 16 per inch.

Figure 4A:
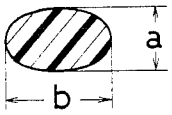
FIG. 4A is a transverse sectional view of an erect fiber.
Figure 4B:
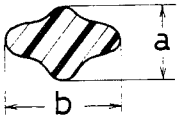
FIG. 4B is a transverse sectional view of an erect fiber of another embodiment of the present invention.

Each long fiber forming the bristle erect piles in the present invention preferably has a flat section of a flatness of 1.5 or above. Such flat fibers as defined above may bring about desirable bristle erect piles without enhancing the roughness nor the ratio thereof. The flat section as described herein denotes an ellipse as shown in FIG. 4A or a flat cross section as shown in in FIG. 4B. The flatness is expressed in the major/minor axes ratio and represented by b/a in FIGS. 4A and 4B.

In the present invention, the long fibers and short fibers different from each other in the lightness may be obtained by, for example, the following methods (1) fibers previously dyed dark are cut to a definite length and employed as the short fibers while those dyed pale are cut longer and employed as the long fibers; or (2) fibers cut to a definite length are dyed dark and employed as the short fibers while those cut longer are dyed pale and employed as the long fibers.

The erect piles may be formed by, for example, blending filaments or staples of the long and short fibers each dyed in the abovementioned manner at an appropriate weight ratio and flocking a fabric, a knit or a nonwoven fabric therewith; knitting the same into a pile fabric; knitting the same with a sliver knitter; or fabricating the same into a double-layered fabric and then cutting the pile yarns connecting the two layers with a knife to thereby form a pile fabric. Namely, processes disclosed in Japanese patent application Kokai (=laying-open) publication Nos. 57-61739 and 57-167434 are preferably employed.

The long fibers and the short fibers may be blended in a ratio of 10 to 90/90 to 10, preferably 35 to 65/65 to 35.

The fur-type product thus obtained may be further subjected to some post-treatment such as backing, raising or brushing if required.

As described above, the artificial fur of the present invention is one having a two-layer erect pile structure comprising erect piles of long fibers and those of short fibers, wherein the lightness of said short fibers is lower by 0.5 or above than that of said long fibers. Thus the long fibers are more conspicuous than the short fibers, which results in a definite appearance wherein the covering effect of the long fibers is sufficiently emphasized. Thus an artificial fur having a deep and definite color and a glossy appearance may be obtained.

EXAMPLE 1

Sharpening of long fibers for bristles

Three staples were prepared by cutting a polybutylene terephthalate filament of 40 deniers having an elliptic cross section of 2.0 in flatness as shown in FIG. 4A to 35 mm, 33 mm and 29 mm. Each staple was formed into a fiber bundle of 4 cm in diameter and covered therearound with paper. The obtained paper-enclosed fiber bundle was immersed in a 40% solution of caustic soda and treated at 105° C. for 60 minutes. Then it was thoroughly washed with water to thereby remove decomposition products. The fibers thus obtained had sharpened tips and fiber lengths thereof were 29 mm, mm and 23 mm, respectively.

Dyeing of long fibers for bristles

The staples (A) sharpened in the above manner were dyed at 120° C. for 60 minutes with the following formulation with a high-pressure paddle dyeing machine:

| | |
|---|---|
| Dianix Yellow Brown 2R-FS (disperse dye; mfd. by Mitsubishi Chemical); | 5.40% o.w.f. |
| Dianix Red BN-SE | 1.05% o.w.f. |
| Dianix Blue BG-FS | 0.27% o.w.f. |
| Ionet TD-208 (leveling agent; mfd. by Sanyo Chemical); and | 0.5 g/l |
| Fixer PH-500 (pH adjustor; mfd. by Sanyo Chemical); | 0.5 g/l |
| bath ratio: | 1:30. |

After dyeing, each staple was subjected to reductive washing in a wellknown manner, washed with hot water and then with cold water, and dried.

1 g of each staple, which was thus dyed reddish brown, was introduced into a cell of 35 mm in diameter and 5 mm in depth of a digital colorimetric color difference computer AUD-SCH-2 (mfd. by Suga Test Instruments Co., Ltd.) and the lightness (L) thereof was determined. Table 1 shows the result.

Dyeing of shoft fibers for wooly hairs

Three polyethylene terephthalate staples of two deniers in fineness and different lengths (2d×20 mm, 2d×18 mm, and 2d×16 mm) were prepared. Each staple was made to have a low crimp, i.e., 3.8% in crimp ratio and 7.0 per inch in crimp number. These staples were dyed with the following formulation at 130° C. for 60 minutes with a package dyeing machine:

| | |
|---|---|
| Resolin Blue BBLS (disperse dye; mfd. by Bayer); | 6.00% o.w.f. |
| Terasil Orange 5RL 150% (disperse dye; mfd. by Ciba-Geigy); | 0.15% o.w.f.; |
| Kayalon Polyester Rubine BLS 200% (disperse dye; mfd. by Nippon Kayaku); | 0.15% o.w.f. |
| Ionet TD-208 | 0.5 g/l; and |
| Fixer PH-500 | 0.5 g/l; |
| bath ratio: | 1:7. |

The lightness (L) of each staple, which was thus dyed blue, was determined in the same manner as described in (2). Table 1 shows the result.

Production of fur-type fabric

A fur-type pile fabric was produced from pile yarns obtained by mixed spinning of the long fibers for bristles and the short fibers for wooly hairs each obtained in the abovementioned manner. Prior to weaving, the following three pile yarns E, F and G were prepared:

pile yarn (E): mixed spinning of long fibers for bristles of 40d×29 mm (reddish brown) with short fibers for wooly hairs of 2d×20 mm (blue);

pile yarn (F): mixed spinning of long fibers for bristles of 40d×27 mm [the same color as that of the bristles of pile yarn (E)] with short fibers for wooly hairs of 2d×18 [the same color as that of the wooly hairs of pile yarn (E)]; and pile yarn (G): mixed spinning of long fibers for bristles of 40d×23 [the same color as that of the bristles of pile yarn (E)] with short fibers for wooly hairs of 2d×16 [the same color as that of the wooly hairs of pile yarn (E)].

The blending ratio of the long fibers for the bristles to the short fibers for the wooly hairs of each pile yarn was 40/60% by weight.

In the weaving of the above pile fabric, the pile yarns were arranged in the following manner to thereby obtain the multiridge structure wherein each ridge comprised a gentle dome-type erect pile as shown in FIG. 1A. Namely, the pile yarn (E) formed the central erect pile portion of 7 mm in width. In each side of this central portion, an erect pile portion of a mixture of the pile yarns (E) and (F), that of the pile yarn (F), that of a mixture of the pile yarns (F) and (G) and that of the pile yarn (G) each 7 mm in width were located to thereby give a total ridge width of 63 mm.

Long polyethylene terephthalate fibers were employed as the homespun warps forming the base structure. Pale brown terephthalate threads were employed as the warps of the main base structure while dark brown polyethylene terephthalate threads were employed at each boundary of 6 mm in width between ridges After weaving, the grey fabric was back-coated with a polyurethane resin and erect piles on the surface of the grey fabric were unfolded and loosened to thereby give a pile fabric. The obtained pile fabric was in a multiridge structure wherein ridges of gentle dome erect piles having a ridge pitch of 6.3 cm were repeated along the direction of the width, as shown in FIG. 1A. On the back of the pile fabric, dark brown base structures 5 of 6 mm in width were striped on the pale brown main base structure.

Table 1 obviously suggests that the lightness of the wooly hairs of the artificial fur of the present invention is lower by 5.5 than that of the bristles. The reddish brown bristles of this artificial fur could be clearly observed among the blue wooly hairs, which brought about a definite appearance wherein the covering effect of the bristles was sufficiently emphasized. Further it showed an appearance with depth and gloss giving an impression of high-gradeness.

EXAMPLE 2

Dyeing of long fibers for bristles

The same bristle staples as those used in Example 1 were dyed with the following formulation under the same condition as the one described in Example 1.

Resolin Blue FBL 2% o.w f.

The lightness (L) of each staple, which was thus dyed blue, was determined in the same manner as the one described in Example 1. Table 1 shows the result. Dyeing of short fibers for wooly hairs:

The same staples for wooly hairs as those used in Example 1 were dyed with the following formulation under the same condition as the one described in Example 1.

| | |
|---|---|
| Dianix Yellow Brown 2R-FS | 1.25% o.w.f.; |
| Dianix Red BN-SE | 0.18% o.w.f.; and |
| Dianix Blue BG-FS | 0.30% o.w.f. |

The lightness (L) of each staple, which was thus dyed brown, was determined. Table 1 shows the result.

Production of fur-type fabric

A fur-type pile fabric was produced from these dyed staples as obtained above in the same manner as the one described in Example 1.

Table 1 obviously suggests that the lightness of the wooly hairs of the artificial fur is lower by 1.7 than that of the bristles. This artificial fur had deep and excellent colors although the color combination thereof was completely contrary to that of the product of Example 1. However the brown wooly hairs of the former could be slightly observed among the bristles of the same, which made the appearance thereof somewhat inferior to that of the latter.

EXAMPLE 3

Dyeing of long fibers for bristles

The same staples as those used in Example 1 were dyed with the following formulation under the same condition as the one described in Example 1.

| | |
|---|---|
| Sumikaron Brilliant Red S-2BL (disperse dye; mfd. by Sumitomo Chemical); | 1.0% o.w.f. |
| Resolin Brilliant Red BS | 1.0% o.w.f.; |
| Kayalon Polyester Light Scarlet GS-200 | 3.4% o.w.f.; and |
| Foron Rubine S-2GFL (disperse dye; mfd. by Sandoz). | 1.2% o.w.f. |

The lightness (L) of each staple, which was thus dyed yellowish red, was determined to be 28.2 in the same manner as the one described in Example 1 (cf. Table 1).

Dyeing of short fibers for wooly hairs

The same staples for wooly hairs as those used in Example 1 were dyed with the following formulation under the same condition as the one described in Example 1.

Samaron Black BBL Liquid-150: 15% o.w.f. (disperse dye; mfd. by Hoechst).

The lightness (L) of each staple, which was thus dyed black, was determined to be 15.7 in the same manner as the one described in Example 1 (cf. Table 1). Production of fur-type fabric A fur-type pile fabric was produced from the staples prepared above in the same manner as the one described in Example 1.

Table 1 obviously suggests that the lightness of the wooly hairs of this artificial fur is lower by 12.5 than that of the bristles. The red bristles of this product seemed to cover the black wooly hairs thereof, thus providing an appearance with depth and gloss giving an impression of high-gradeness.

EXAMPLE 4

Dyeing of long fibers for bristles

The procedure of Example 1 was followed.

Dyeing of short fibers for wooly hairs

The procedure of Example 3 was followed.

Production of fur-type fabric

A fur-type pile fabric was produced from the above dyed staples in the same manner as the one described in Example 1.

Table 1 obviously suggests that the lightness of the wooly hairs of this artificial fur is lower by 6.5 than that of the bristles. The reddish brown bristles of this product seemed to cover the black wooly hairs, which made the latter inconspicuous. Thus it had an appearance with depth and gloss giving an impression of high-gradeness.

COMPARATIVE EXAMPLE 1

Dyeing of long fibers for bristles

The same staples for bristles as those used in Example 1 were dyed with the following formulation under the same condition as the one described in Example.

| | |
|---|---|
| Resolin Blue BBLS | 0.03% o.w.f.; |
| Terasil Orange 5RL 150% | 0.24% o.w.f.; and |
| Kayalon Polyester Rubine BLS 200% | 0.88% o.w.f. |

The lightness (L) of each staple, which was thus dyed bluish red, was determined in the same manner as the one described in Example 1. Table 1 shows the result.

Dyeing of short fibers for wooly hairs

The same staples for wooly hairs as those used in Example 1 were dyed with the following formulation under the same condition as the one described in Example 1.

| | |
|---|---|
| Resolin Blue FBL | 1.25% o.w.f.; |
| Palanil Yellow 3G (disperse dye; mfd. by BASF). | 1.10% o.w.f.; and |
| Terasil Orange 5RL 150% | 0.45% o.w.f. |

The lightness (L) of each staple, which was thus dyed yellowish green, is shown in Table 1.

Production of fur-type fabric

A fur-type pile fabric was obtained from these dyed staples in the same manner as the one described in Example 1.

Table 1 obviously suggests that the lightness of the bristles of this artificial fur is the same as that of the wooly hairs thereof. The fur has an unfavorable appearance as if the red bristles of this product were spotted on the green wooly hairs.

COMPARATIVE EXAMPLE 2

Dyeing of long fibers for bristles

The same staples for bristles as those used in Example 1 were dyed with the following formulation under the same condition as the one described in Example 1.

| | |
|---|---|
| Samaron Black BBL Liquid-150 | 10% o.w.f.; and |
| Samaron Brown 2GSL-N | 12% o.w.f. |

The lightness (L) of each staple, which was thus dyed black, was determined in the same manner as the one described in Example 1. Table 1 shows the result. Dyeing of short fibers for wooly hairs:

The same staples for wooly hairs as those used in Example 1 were dyed with the following formulation under the same condition as the one described in Example 1.

| | |
|---|---|
| Terasil Orange 5RL 150% | 0.45% o.w.f.; and |
| Kayalon Polyester Rubine BLS 200% | 1.05% o.w.f. |

The lightness (L) of each staple, which was thus dyed red, is shown in Table 1.

Production of fur-type fabric

A fur-type pile fabric was obtained from these dyed staples in the same manner as the one described in Example 1.

Table 1 obviously suggests that the lightness of the wooly hairs of this artificial fur is higher than that of the bristles of the same. This product had a color combination completely contrary to that of the product of Example 3. The appearance of the former was very poor wherein the bristles showed no covering effect and the red wooly hairs were conspicuous.

COMPARATIVE EXAMPLE 3

Dyeing of long fibers for bristles

The procedure of Comparative Example 2 was followed.

Dyeing of short fibers for wooly hairs

The procedure of Example 2 was followed.

Production of fur-type fabric

A fur-type pile fabric was obtained from these dyed staples in the same manner as the one described in Example 1.

Similar to the product of Comparative Example 2, the lightness of the wooly hairs of this artificial fur was higher than that of the bristles of the same. The obtained product had a poor appearance wherein the bristles showed no covering effect and the black wooly hairs were conspicuous.

TABLE 1

| | Color Combination | | Lightness (L) | | | |
|---|---|---|---|---|---|---|
| | bristle | wooly hair | bristle | wooly hair | Difference in L | Appearance* |
| Ex. 1 | brown | blue | 22.2 | 16.7 | 5.5 | o |
| Ex. 2 | blue | brown | 23.8 | 22.1 | 1.7 | o~Δ |
| Comp. Ex. 1 | red | green | 22.6 | 22.6 | 0 | x |
| Ex. 3 | red | black | 28.2 | 15.7 | 12.5 | o |
| Comp. Ex. 2 | black | red | 18.4 | 24.2 | −3.8 | x |
| Ex. 4 | brown | black | 22.2 | 15.7 | 6.5 | o |
| Comp. Ex. 3 | black | brown | 18.4 | 22.1 | −3.7 | x |

*o: Deep and glossy, wherein wooly hairs are covered with bristles.
Δ: Wooly hairs are somewhat observed.
x: Wooly hairs are well observed.

EXAMPLE 5

Dyeing of long fibers for bristles

The same sharpened staples as those used in Example 1 were dyed with the following formulation at 120° C. for 60 minutes with a high-pressure paddle dyeing machine. Each dye was a dispersion dye.

| | |
|---|---|
| Resolin Blue BBLS | 0.03% o.w.f. |
| Terasil Orange 5RL 150% | 0.24% o.w.f. |
| Kayalon Polyester Rubine BLS 200% | 0.88% o.w.f. |
| Ionet TD-208 | 0.5 g/l; and |
| Fixer PH-500 | 0.5 g/l; |
| bath ratio: | 1:30. |

After dyeing, each staple was subjected to reductive washing in a well-known manner, washed with hot water and then cold water, and dried.

The lightness (L) of each staple, which was thus dyed blue, was determined in the same manner as the one described in Example 1. Table 2 shows the result.

Dyeing of short fibers for wooly hairs

The same staples for wooly hairs as those used in Example 1 were dyed with the following formulation at 130° C. for 60 minutes with a package dyeing machine.

| | |
|---|---|
| Samaron Black BBL liquid-150 | 15% o.w.f. |
| Ionet TD-208 | 0.5 g/l; and |
| Fixer PH-500 | 0.5 g/l; |
| bath ratio: | 1:7. |

The lightness (L) of each staple, which was thus dyed black, was determined in the same manner as the one described in Example 1. Table 2 shows the result.

Production of fur-type fabric

A fur-type pile fabric was produced from pile yarns obtained by mixed spinning of the long fibers for bristles and the short fibers for wooly hairs each obtained in the abovementioned manner. Prior to weaving, the following three pile yarns H, I and J were prepared:

pile yarn (H): mixed spinning of long fibers for bristles of 40d×29 mm (bluish red) with short fibers for wooly hairs of 2d×20 mm (black);

pile yarn (I): mixed spinning of long fibers for bristles of 40d×27 mm [the same color as that of the bristles of pile yarn (H)] with short fibers for wooly hairs of 2d×18 mm [the same color as that of the wooly hairs of pile yarn (H)]; and pile yarn (J): mixed spinning of long fibers for bristles of 40d×23 mm [the same color as that of the bristles of pile yarn (H)] with short fibers for wooly hairs of 2d×16 mm [the same color as that of the wooly hairs of pile yarn (H)].

The blending ratio of the long fibers for the bristles to the short fibers for the wooly hairs of each pile yarn was 40/60% by weight.

In the weaving of the above pile fabric, the pile yarns were arranged in the following manner to thereby obtain the multiridge structure as shown in FIG. 1A. Namely, the pile yarn (H) formed the central erect pile portion of 7 mm in width. In each side of this central portion, an erect pile portion of a mixture of the pile yarns (H) and (I), that of the pile yarn (I), that of a mixture of the pile yarns (I) and (J) and that of the pile yarn (J) each 7 mm in width were located to thereby give a total ridge width of 63 mm.

Similar to Example 1, pale brown terephthalate threads were employed as the warps of the main base structure while dark brown polyethylene terephthalate threads were employed at each boundary of 6 mm in width between ridges.

After weaving, the grey fabric was back-coated with a polyurethane resin and erect piles on the surface of the grey fabric were unfolded and loosened to thereby give a pile fabric. The obtained pile fabric was in a multiridge structure wherein ridges of gentle dome erect piles having a ridge pitch of 6.3 cm were repeated along the direction of the width, as shown in FIG. 1A. On the back of the pile fabric, dark brown base structures 5 of 6 mm in width were striped on the pale brown main base structure.

Table 2 obviously suggests that the lightness of the wooly hairs (i.e. short fibers) of the artificial fur of the present invention is lower than that of the bristles (i.e. long fibers) and the former has an achromatic color. The red bristles of this artificial fur could be clearly observed among the black wooly hairs, which brought about a definite appearance wherein the covering effect of the bristles was sufficiently emphasized. Further it showed an appearance with depth and gloss giving an impression of high-gradeness.

EXAMPLE 6

Dyeing of long fibers for bristles

The same staples as those used in Example 1 were dyed with the following formulation at 130° C. for 60 minutes with a high-pressure paddle dyeing machine.

| | |
|---|---|
| Resolin Blue BBLS | 2.0% o.w.f. |
| Ionet TD-208 | 0.5 g/l; and |
| Fixer PH-500 | 0.5 g/l. |

The lightness (L) of each staple, which was thus dyed blue, was determined to be 23.8 in the same manner as the one described in Example 1 (cf. Table 2).

Dyeing of short fibers for wooly hairs

The same staples as those used in Example 1 were dyed under the same condition as the one described in Example 5. The lightness (L) of each staple, which was thus dyed black, was determined to be 15.7 in the same manner as the one described in Example 1 (cf. Table 2).

Production of fur-type fabric

A fur-type pile fabric was obtained from these staples in the same manner as the one described in Example 5.

Similar to the product of Example 5, the blue bristles of this artificial fur were more conspicuous than the black wooly hairs thereof, which brought about a definite appearance with depth and gloss giving an impression of high-gradeness.

EXAMPLE 7

Dyeing of long fibers for bristles

The same staples as those used in Example 1 were dyed with the following formulation under the same condition as the one described in Example 1.

| | |
|---|---|
| Palanil Yellow 3G | 2% o.w.f.; and |
| Resolin Blue FBL | 2% o.w.f. |

Dyeing of short fibers for wooly hairs

The procedure of Example 5 was followed.

Production of fur-type fabric

A glossy green artificial fur of a definite appearance with depth was obtained from these staples in the same manner as those described in Examples 5 and 6.

EXAMPLE 8

The same staples for bristles as those used in Example 5 and gray staples for wooly hairs dyed with the same dye formulation as the one used in Example 5 at a concentration corresponding to ½ of the same were employed. Thus a fur-type pile fabric was obtained in the same manner as the one described in Example 5.

Table 2 obviously suggests that the lightness (L) of the gray wooly hairs of the obtained artificial fur is lower than that of the red bristles of the same. However the difference in the L values is so small, i.e., 1.2 that the covering effect of the bristles on the wooly hairs was low. Therefore this product was somewhat inferior to that of Example 5 in its definiteness, depth and gloss.

EXAMPLE 9

Dyeing long fibers for bristles

The same staples as those used in Example 1 were dyed with the following formulation at 100° C. for 30 minutes.

| | |
|---|---|
| Sumikaron Bril Red S-2BL | 0.06% o.w.f.; |
| Resolin Bril Red BS | 0.06% o.w.f.; |
| Kayalon Polyester Light Scarlet G-S 200% | 0.21% o.w.f.; and |
| Foron Rubine S-2-GFL | 0.08% o.w.f. |

Dyeing of short fibers for wooly hairs

The same staples as those used in Example 1 were dyed with the following formulation at 100° C. for 30 minutes.

| | |
|---|---|
| Palanil Yellow 3 G | 0.094% o.w.f.; |
| Resolin Red FB | 0.100% o.w.f.; |
| Resolin Blue FBL | 0.086% o.w.f.; |
| Ionet TD-208 | 0.5 g/l; and |

-continued

| | |
|---|---|
| Fixer PH-500 | 0.5 g/l. |

The lightness (L) of each staple, which was thus dyed gray, was determined in the same manner as the one described in Example 1. Table 2 shows the result.

Production of fur-type fabric

A fur-type pile fabric was obtained from these staples in the same manner as the one described in Example 5.

Similar to the products of Examples 5, 6 and 7, the bristles of this artificial fur showed a sufficient covering effect. Thus the pale red bristles were more conspicuous than the gray wooly hairs, which brought about a definite appearance with depth and gloss in spite of its pale color.

| | |
|---|---|
| Dianix Yellow Brown 2R-FS | 1.25% o.w.f.; |
| Dianix Red BN-SE | 0.18% o.w.f.; and |
| Dianix Blue BG-FS | 0.30% o.w.f. |

The lightness (L) of each staple, which was thus dyed brown, was determined in the same manner as the one described in Example 1. Table 2 shows the result.

Production of fur-type fabric

A fur-type pile fabric was obtained from these staples in the same manner as the one described in Example 5.

This artificial fur was inferior to the product of Example 5 in the depth, definiteness and gloss, although the wooly hairs of the former had a chromatic color and a lower lightness than the bristles of the same.

TABLE 2

| | Color combination | | Lightness | Wooly hair | | | Difference in | |
|---|---|---|---|---|---|---|---|---|
| | bristle | wooly hair | of bristle (L) | L | a | b | L | Appearance* |
| Ex. 5 | red | black | 24.4 | 15.7 | −2.10 | 1.45 | 8.7 | o |
| Ex. 6 | blue | black | 23.8 | 15.7 | −2.10 | 1.45 | 8.1 | o |
| Ex. 7 | green | black | 22.8 | 15.7 | −2.10 | 1.45 | 7.1 | o |
| Ex. 8 | red | gray | 24.4 | 23.2 | −3.18 | 1.96 | 1.2 | Δ |
| Ex. 9 | red | gray | 53.2 | 48.4 | 0.76 | 1.93 | 4.8 | o |
| Comp. Ex. 4 | red | gray | 24.4 | 48.4 | 0.76 | 1.93 | −24.0 | x |
| Comp. Ex. 5 | red | white | 24.4 | 87.2 | −0.14 | 0.16 | −62.8 | x |
| Comp. Ex. 6 | red | brown | 24.4 | 22.1 | 5.22 | 7.68 | 3.1 | Δ~x |

*o: Deep and glossy.
Δ: Inferior in depth and gloss.
x: Wooly hairs are conspicuous and poor in appearance.

COMPARATIVE EXAMPLE 4

Production of fur-type fabric

The same bristle staples as those used in Example 5 and the same wooly hairs as those used in Example 9 were employed. Thus a fur-type pile fabric was obtained in the same manner as the one described in Example 5.

As shown in Table 2, the lightness of the wooly hairs of this artificial fur is higher than that of the bristles of the same, although the former has an achromatic color, so that no covering effect of the red bristles could be observed. Thus the gray wooly hairs were conspicuous which made the appearance of the same poor.

COMPARATIVE EXAMPLE 5

Production of fur-type fabric

A fur-type pile fabric was produced from the same bristle staples as those used in Example 5 and the same wooly hair fibers as those used therein.

The obtained artificial fur showed conspicuous white wooly hairs and was significantly poor in appearance.

COMPARATIVE EXAMPLE 6

Long fibers for bristles

The same staples as those used in Example 5 were employed.

Dyeing of short fibers for wooly hairs

The same staples as those used in Example 1 were dyed with the following formulation.

We claim:

1. An artificial fur having an at least double layer structure comprising an erect pile layer of long fibers and an erect pile layer of short fibers, wherein the lightness of said short fibers is lower by at least 0.5 than that of said long fibers.

2. An artificial fur as set forth in claim 1, wherein the lightness of said short fibers is lower by at least 2.5 than that of said long fibers.

3. An artificial fur as set forth in claim 1, wherein said short fibers have a substantially achromatic color.

4. An artificial fur as set forth in claim 1, wherein the difference in the lengths of the erect pile layer of said long fibers and that of said short fibers is 5 mm or above.

5. An artificial fur as set forth in claim 1, wherein said long fibers are 10 to 70 mm in length while said short fibers are 5 to 50 mm in length.

6. An artificial fur as set forth in claim 1, wherein said long fibers are thicker than said short fibers and the fineness of the former is 5 to 60 deniers while that of the latter is 0.1 to 5 deniers.

7. An artificial fur as set forth in claim 1, wherein the tips of the erect piles of said long fibers are sharpened.

8. An artificial fur as set forth in claim 1, wherein the tips of the erect piles of said short fibers are sharpened.

9. An artificial fur as set forth in claim 1, wherein the cross section of each long fiber has a flatness of 1.5 or above.

10. An artificial fur as set forth in claim 1, wherein the erect pile layers are in a multiridge structure where ridges are substantially along the direction of the hair.

11. An artificial fur as set forth in claim 10, wherein the width of each ridge of said multiridge erect pile structure is 3 to 10 cm.

12. An artificial fur as set forth in claim 1, wherein said long fibers and said short fibers are mixed in a ratio of 10 to 90/ 90 to 10.

13. An artificial fur as set forth in claim 1, wherein said long fibers are straight and noncrimp fibers.

14. An artificial fur as set forth in claim 1, wherein said short fibers are low-crimp fibers having a crimp ratio of approximately 13% or below and the number of crimps of approximately 16 per inch.

15. An artificial fur as set forth in claim 1, wherein said long fibers are synthetic polyester fibers.

16. An artificial fur as set forth in claim 15, wherein said synthetic polyester fibers are selected from among polyethylene terephthalate and polybutylene terephthalate.

17. An artificial fur as set forth in claim 1, wherein said short fibers are synthetic polyester fibers.

18. An artificial fur as set forth in claim 17, wherein said synthetic polyester fibers are selected from among polyethylene terephthalate and polybutylene terephthalate.

* * * * *